US006730639B1

(12) United States Patent
Miyamoto et al.

(10) Patent No.: US 6,730,639 B1
(45) Date of Patent: May 4, 2004

(54) GREASE COMPOSITION FOR BEARINGS OF INFORMATION DEVICES

(75) Inventors: Yasuhiro Miyamoto, Kobe (JP); Motoharu Akiyama, Nagano-ken (JP); Seiji Okamura, Kobe (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 09/625,148

(22) Filed: Jul. 25, 2000

(30) Foreign Application Priority Data

Nov. 13, 1999 (JP) ..... 11-359608

(51) Int. Cl.[7] ..... C01M 141/12

(52) U.S. Cl. ..... 508/364; 508/365; 508/462; 508/108

(58) Field of Search ..... 508/108, 364, 508/365, 462

(56) References Cited

U.S. PATENT DOCUMENTS 2,739,127 A * 3/1956 Morway et al. ..... 508/462
5,009,803 A * 4/1991 Brandolese ..... 508/462
5,262,076 A * 11/1993 Ishida et al. ..... 508/462
5,290,464 A * 3/1994 Fisicaro et al. ..... 508/462
5,401,105 A * 3/1995 Suzuki et al. ..... 508/100
5,668,092 A * 9/1997 Denton ..... 508/146
5,763,370 A * 6/1998 Doner et al. ..... 508/364
5,858,931 A * 1/1999 Tanaka et al. ..... 509/364
6,022,835 A * 2/2000 Fletcher ..... 508/365
6,235,690 B1 * 5/2001 Shibayama et al. ..... 508/462
6,500,788 B2 * 12/2002 Shibayama et al. ..... 508/462

FOREIGN PATENT DOCUMENTS

| | | |
|---|---|---|
| JP | 10-169657 | 6/1998 |
| JP | 10-339326 | 12/1998 |
| JP | 11-13769 | 1/1999 |

OTHER PUBLICATIONS

The Analysis of Mechanical Variables Influencing Fretting Corrosion in Grease Lubricated Bearings, by John B. Christian et al, *Lubrication Engineering*, Oct., 1971, pp. 342–349.

* cited by examiner

*Primary Examiner*—Jacvqueline V. Howard
(74) *Attorney, Agent, or Firm*—Flynn, Thiel, Boutell & Tanis, P.C.

(57) ABSTRACT

A grease composition for bearings of information devices comprising a carbonate base oil, a lithium soap, and at least one organomolybdenum compound selected from molybdenum dithiophosphates and molybdenum dithiocarbanates.

18 Claims, No Drawings

GREASE COMPOSITION FOR BEARINGS OF INFORMATION DEVICES

BACKGROUND OF THE INVENTION

1. Field of the Invention

This invention relates to a grease composition, which is adapted for use in bearings of spindle motors ordinarily employed in peripheral information devices such as HDD (hard disk drive) and FDD (floppy disk drive) memories, CDD (compact disk drive), MOD (magneto-optical disk drive) and the like of computer systems, and VTR (video tape recorder).

2. Description of the Prior Art

In general, performances required for a bearing grease composition, which is employed in peripheral information devices such as HDD (hard disk drive) and FDD (floppy disk drive) memories, CDD (compact disk drive), MOD (magneto-optical disk drive) and the like of computer systems, and VTR (video tape recorder), include a reduced degree of grease dusting or scattering, a small torque, an excellent acoustic property, a long life, and the like.

Especially, with these information devices usually employed in a clean environment, it has been often experienced that a gaseous oil or fine particles of a grease scattered from the inside of a bearing at the time of rotations often cause the surfaces of a disk or the like to be contaminated, resulting in malfunction of the device. Thus, it has been accepted as the most important how to suppress the amount of the scattered oil or grease. Extensive studies have been made on this area.

In recent years, attention has been paid, as a very important problem to solve, to a phenomenon called fretting. More particularly, when ball bearings particularly used in information devices undergo vibrations at a low frequency of about 5 to 10 Hz caused during the course of carrying out and in of information devices or at the time of carrying such devices, race faces in contact with balls inside a bearing suffer damages and are degraded.

When fretting takes place, the acoustic characteristics of the ball bearing not only are worsened, but also adversely influence the performance of the information device.

SUMMARY OF THE INVENTION

It is an object of the invention to provide a grease composition for bearings of information devices, which ensures not only a high performance and a long life while suppressing an amount of an oil or grease scattered from the bearing, but also such an effect of not causing the fretting phenomenon.

It is another object of the invention to provide a grease composition for bearings of rolling of information devices which can satisfy properties required for the grease composition used in peripheral information devices such as HDD (hard disk drive) and FDD (floppy disk drive) memories, CDD (compact disk drive), MOD (magneto-optical disk drive) and the like of computer systems, and VTR (video tape recorder), i.e. a reduced degree of dusting or scattering, a small torque, an excellent acoustic property and a long life during the course of high revolutions, and also can suppress the fretting phenomenon from occurring.

It will be noted that the term "bearing of an information device" is intended to mean a bearing of a spindle motor, which is used in the peripheral information devices such as HDD (hard disk drive) and FDD (floppy disk drive) memories, CDD (compact disk drive), MOD (magneto-optical disk drive) and the like of computer systems, and VTR (video tape recorder).

The above objects can be achieved, according to the invention, by a grease composition, which comprises:

a carbonate compound of the following general formula (i) serving as a base oil

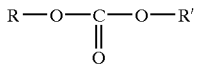

(i)

wherein R and R' may be the same or different and independently represent a branched alkyl group having from 13 to 15 carbon atoms;

a lithium soap serving as a thickener; and at least one organomolybdenum compound selected from the group consisting of a molybdenum dithiophosphate of the general formula (ii)

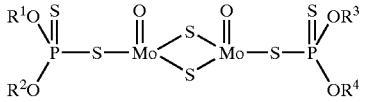

(ii)

wherein $R^1$, $R^2$, $R^3$ and $R^4$ independently represent an alkyl group having from 1 to 24 carbon atoms or an aryl group having from 6 to 30 carbon atoms, and a molybdenum dithiocarbamate of the general formula (iii)

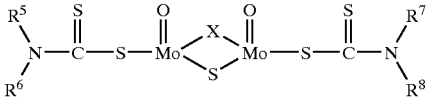

(iii)

wherein $R^5$, $R^6$, $R^7$ and $R^8$ independently represent an alkyl group having from 1 to 24 carbon atoms, and X represents O or S. This grease composition is excellent in characteristics for use in a bearing of information devices and does not cause any fretting phenomenon to occur.

EMBODIMENTS OF THE INVENTION

When a carbonate compound of the following general formula (i) is used as a base oil,

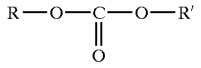

(i)

wherein R and R' may be the same or different and independently represent a branched alkyl group having from 13 to 15 carbon atoms, the resultant grease composition exhibits excellent characteristics such that while characteristic properties required for information devices, e.g. a reduced degree of dusting (scattering) of the grease, a small torque, an excellent acoustic characteristic, a long life, and the like, can be imparted to the device, fretting is not caused to occur.

The carbonate used in the present invention is represented by the formula (I) in which R and R' may independently be a branched alkyl group having from 13 to 15 carbon atoms and may be the same or different. Specific examples include those carbonates of the following general formulas (v), (vi) and (vii)

(v)

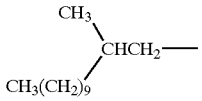

(vi)

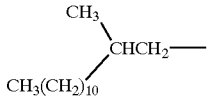

(vii)

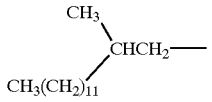

In the practice of the invention, an alkyl diphenyl ether or a polyol ester may be used in combination as base oil component.

The grease composition of the invention should preferably comprise 70 to 95 parts by weight of the carbonate and 5 to 30 parts by weight of a lithium metal salt.

If the lithium metal salt is less than 5 parts by weight, a mixing consistency becomes so low that the resultant mixture is unfavorably apt to escape or scatter when a bearing filled therewith is rotated, with the possibility that HDD, FDD and the like are contaminated therewith.

On the other hand, when the content exceeds 30 parts by weight, the resultant mixture becomes so hard that the fluidity of the resulting grease composition inside a bearing becomes poor. This may unfavorably lead to a failure in lubrication.

Further, the grease composition for a bearing of information devices according to the invention may further comprise, as a fourth component, additives ordinarily employed in the grease composition, such as antioxidants, rust inhibitors and the like.

The at least one organomolybdenum compound selected from the molybdenum dithiophosphate and the molybdenum dithiocarbamate should preferably be present in an amount of 0.5 to 5 wt %, more preferably from 1 to 3 wt %, based on 100 parts by weight of the total of the base oil and the thickening agent.

Preferred embodiments of the invention are summarized below.

(1) A grease composition for a bearing of information devices comprising:

a carbonate compound of the following general formula (i) serving as a base oil (i)

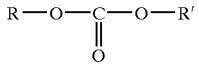

wherein R and R' may be the same or different and independently represent a branched alkyl group having from 13 to 15 carbon atoms;

a lithium soap serving as a thickener; and at least one organomolybdenum compound selected from the group consisting of a molybdenum dithiophosphate of the general formula (ii)

(ii)

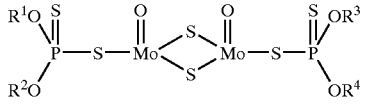

wherein $R^1$, $R^2$, $R^3$ and $R^4$ independently represent an alkyl group having from 1 to 24 carbon atoms or an aryl group having from 6 to 30 carbon atoms, and a molybdenum dithiocarbamate of the general formula (iii)

(iii)

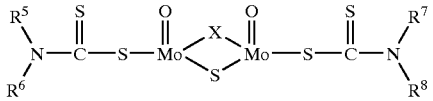

wherein $R^5$, $R^6$, $R^7$ and $R^8$ independently represent an alkyl group having from 1 to 24 carbon atoms, and X represents O or S.

(2) The grease composition as recited in (1) above, wherein the base oil is made of a carbonate compound of the following general formula (i)

(i)

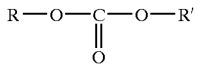

wherein R and R' may be the same or different and independently represent a branched alkyl group of the following general formula (iv)

(iv)

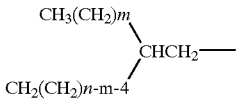

wherein n=13 to 15 and m=0 to 6.

(3) A grease composition for a bearing of information devices which comprises 70 to 95 parts by weight of a carbonate compound of the general formula (i)

(i)

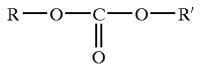

wherein R and R' may be the same or different and independently represent a branched alkyl group of the following general formula (iv)

(iv)

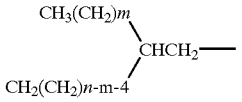

wherein n=13 to 15 and m=0 to 6, and 5 to 30 parts by weight of a lithium soap.

(4) The grease composition as recited in any one of (1) to (3) above, wherein the lithium soap is made of a lithium metal salt prepared from lithium hydroxide and a higher fatty acid having 10 or more carbon atoms or a higher hydroxy fatty acid having 10 or more carbon atoms.

(5) The grease composition as recited in any one of (1) to (4) above, wherein the thickener consists of a plurality of thickeners.

(6) The grease composition as recited in any one of (1) to (5) above, wherein at least one organomolybdenum compound selected from the molybdenum dithiophosphate and molybdenum dithiocarbamate is present in an amount of 0.5 wt % to 5 wt %, preferably from 1 wt % to 3 wt %, based on 100 parts by weight of the total of the base oil and the thickener.

(7) The grease composition as recited in any one of (1) to (6) above, further comprising a fourth component.

The invention is described in more detail by way of examples.

Examples 1 to 8

These examples illustrate grease compositions for bearings of information devices.

A carbonate (hereinafter referred to as carbonate oil A) of the chemical formula (viii), which has a branched alkyl group and corresponds to a compound of the afore-indicated formula (i) in which R is the group of the formula (vi) and R' is the group of the formula (vii), (viii)

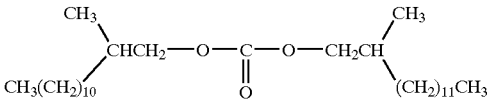

and lithium stearate and/or lithium 12-hydroxystearate were mixed at ratios indicated in Table 1 so that the total amount was at 100 wt %. While agitating the mixture until the mixture was entirely turned into a fluid, it was heated to 220° C. to 230° C. The fluid was poured into a stainless steel container in a thickness of 3 to 5 mm and cooled down to 80° C. or below, after which a molybdenum dithiophosphate and/or molybdenum dithiocarbamate was added to as an organomolybdenum compound. Subsequently, the mixture was homogenized by means of a three-roll mill to obtain a grease composition.

Likewise, aside from the carbonate, lithium soap component and organomolybdenum compound, an alkyl diphenyl ether or a polyol ester was used and formulated at a ratio indicated in Table 1 to obtain grease compositions of Examples 7 and 8.

Comparative Examples 1 to 4

For comparison, two types of commercially available greases whose base oils and thickeners were, respectively, known were provided as Comparative Examples 1 and 2. In Table 2, the symbol "+" indicates formulated components.

Moreover, the base oil and lithium soap were formulated at different ratios indicated in Table 2, and treated in the same manner as in the examples, thereby obtaining grease compositions of Comparative Examples 3, 4, respectively.

The grease compositions of the examples and comparative examples were subjected to measurement of a mixing consistency and a dropping point and also to a motor characteristic test under the same conditions. These results are shown in Tables 1 and 2, respectively.

The mixing consistency was determined according to the method described in JIS K2220 5.3 and the dropping point was determined according to the method described in JIS K2 220 5.4.

The motor characteristic test was performed such that a bearing, in which grease composition to be tested was sealed, was assembled in a spindle motor, and the motor was rotated at normal temperatures at 5,400 r.p.m, to measure noises, an amount of a grease evaporated (scattered), and a torque of rotations.

The noises were measured by use of a microphone located at a distance of 1 m from the end face of a hub of the motor at the time of the rotations of the motor.

The amount of an evaporated (scattered) grease was determined by measuring the weights of the motor prior to and after the rotations and calculating the difference in the weight. The torque was determined by measuring a current value at the time of the rotations of the motor by means of an ammeter, and the torque stability was calculated from the difference between the maximum current value and the minimum current value.

The results of judgment on the respective evaluation items, which were accorded to the performances required for a bearing grease composition for information devices, are shown in Tables 1 (examples) and 2 (comparative examples).

Smaller noises, a more reduced amount of evaporation (scattering), a lower torque, and a smaller variation of the torque stability are, respectively, better.

The respective performances were evaluated by the four ranks of A=excellent, B=good, C=moderate and D=poor.

Further, with regard to a fretting resistance characteristic, ball bearings, which were, respectively, filled with the grease compositions to a bearing space capacity of 10 to 15 vol %, were vibrated at 9 Hz and applied with an angular acceleration of 29.3 radians/second$^2$, under which a generated sound was measured over 60 minutes. This characteristic was evaluated by the four ranks of A=excellent, B=good, C=moderate and D=poor.

TABLE 1

| Example | 1 | 2 | 3 | 4 | 5 | 6 | 7 | 8 |
|---|---|---|---|---|---|---|---|---|
| Thickener StLi | 25 | | 25 | 25 | 25 | 15 | 20 | 20 |
| 12OH StLi | | 10 | | | | 5 | | |
| Base carbonate A | 75 | 90 | 75 | 75 | 75 | 80 | 70 | 70 |
| Oil ADE | | | | | | | 10 | |
| POE | | | | | | | | 10 |
| Organomoly· MoDTP | 1 | 1 | | 0.5 | 1.5 | 2 | 1 | 1 |
| bdenum MoDTC | | | | | 1.5 | | | |
| Viscosity of Base Oil (40° C.) | 18 | 18 | 18 | 18 | 18 | 18 | 25 | 21 |
| Mixing consistency (25° C.) | 199 | 250 | 200 | 210 | 207 | 185 | 212 | 209 |
| Dropping Point (° C.) | 198 | 195 | 201 | 197 | 195 | 195 | 196 | 195 |
| Characteristic Test: | | | | | | | | |
| noises | A | A | A | A | A | A | B | B |
| degree of scattering | A | B | A | A | A | B | A | A |
| torque | A | A | A | A | A | A | B | B |
| torque stability | A | A | A | A | A | A | A | A |
| fretting resistance | A | A | A | A | A | A | A | A |
| Overall Evaluation | A | A | A | A | A | A | B | B |

Note:
StLi lithium stearate
12OH StLi lithium 12-hydroxystearate
ADE alkyl diphenyl ether
POE polyol ester oil

TABLE 2

| Comparative Examples | | 1 | 2 | 3 | 4 |
|---|---|---|---|---|---|
| Thickener | StLi | + | | 25 | 25 |
| | 12OH StLi | + | | | |
| | Na-complex | | + | | |
| Base Oil | Carbonate A | | | 75 | |
| | Diester | + | | | 38 |
| | POE | + | | | 37 |
| | Mineral oil | | + | | |
| Organomolybdenum | MoDTP | | | | 1 |
| | MoDTC | | | | |
| Viscosity or Base Oil (40° C.) | | 26 | 145 | 18 | 18 |
| Mixing consistency (25° C.) | | 250 | 205 | 202 | 210 |
| Dropping point (° C.) | | 194 | >260 | 199 | 196 |
| Characteristic Test: | | | | | |
| noises | | C | D | A | A |
| degree of scattering | | B | A | A | C |
| torque | | C | B | A | B |
| torque stability | | D | C | A | A |
| fretting resistance | | D | D | C | B |
| Overall Evaluation | | D | D | B | C |

Note:
Na-Complex: sodium complex soap
12OH St-Li: lithium 12-hydroxystearate
POE: polyol ester oil.
It should be noted that in Tables 1, 2, the unit of the viscosity of the base oil is expressed by $mm^2/s$.

As will be apparent from Tables 1 and 2, the grease composition for bearings of information devices according to the invention are reduced in the degree of evaporation or scattering, are low in noises and torque, and have good torque stability. In addition, the composition does not undergo any fretting phenomenon.

What is claimed is:

1. In a grease composition for lubricating a bearing of information devices, the improvement comprises said grease composition comprising:

a carbonate compound of the following general formula (i) serving as a base oil

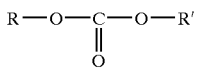

(i)

wherein R and R' may be the same or different and independently represent a branched alkyl group having from 13 to 15 carbon atoms;

a lithium soap serving as a thickener; and at least one organomolybdenum compound selected from the group consisting of a molybdenum dithiophosphate of the general formula (ii)

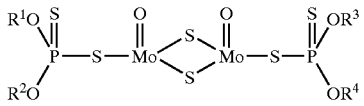

(ii)

wherein $R^1$, $R^2$, $R^3$ and $R^4$ independently represent an alkyl group having from 1 to 24 carbon atoms or an aryl group having from 6 to 30 carbon atoms, and a molybdenum dithiocarbamate of the general formula (iii)

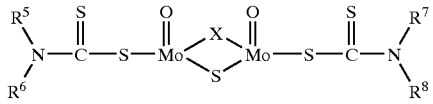

(iii)

wherein $R^5$, $R^6$, $R^7$ and $R^8$ independently represent an alkyl group having from 1 to 24 carbon atoms, and X represents O or S.

2. The grease composition as recited in claim 1, wherein the base oil is made of a carbonate compound of the following general formula (i)

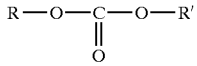

(i)

wherein R and R' may be the same or different and independently represent a branched alkyl group of the following general formula (iv)

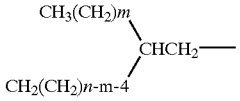

(iv)

wherein n=13 to 15 and m=0 to 6.

3. In a grease composition for lubricating a bearing of information devices, the improvement comprises said grease composition comprising 70 to 95 parts by weight of a carbonate compound of the general formula (i)

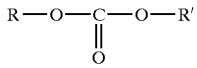

(i)

wherein R and R' may be the same or different and independently represent a branched alkyl group of the following general formula (iv)

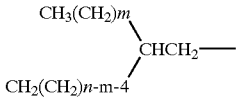

(iv)

wherein n=13 to 15 and m=0 to 6, and 5 to 30 parts by weight of a lithium soap.

4. The grease composition as recited in claim 1, wherein the lithium soap is made of a lithium metal salt prepared from lithium hydroxide and a higher fatty acid having 10 or more carbon atoms or a higher hydroxy fatty acid having 10 or more carbon atoms.

5. The grease composition as recited in claim 1, wherein the thickener consists of a plurality of thickeners.

6. The grease composition as recited in claim 1, wherein at least one organomolybdenum compound selected from molybdenum dithiophosphate and molybdenum dithiocarbamate is present in an amount of 0.5 wt. % to 5 wt. %, preferably from 1 wt. % to 3 wt. %, based on 100 parts by weight of the total of the base oil and the thickener.

7. In a grease composition for lubricating bearings of spindle motors employed in peripheral information devices, the improvement comprises said grease composition containing:

a carbonate compound of the following general formula (i) serving as a base oil

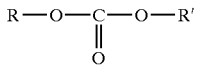

(i)

wherein R and R' may be the same or different and independently represent a branched alkyl group having from 13 to 15 carbon atoms;

a lithium soap serving as a thickener; and at least one organomolybdenum compound selected from the group consisting of a molybdenum dithiophosphate of the general formula (ii)

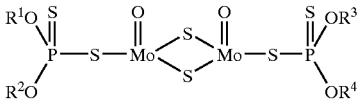

(ii)

wherein $R^1$, $R^2$, $R^3$ and $R^4$ independently represent an alkyl group having from 1 to 24 carbon atoms or an aryl group having from 6 to 30 carbon atoms, and a molybdenum dithiocarbamate of the general formula (iii)

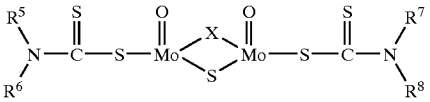

(iii)

wherein $R^5$, $R^6$, $R^7$ and $R^8$ independently represent an alkyl group having from 1 to 24 carbon atoms, and X represents O or S.

8. A method of lubricating bearings of spindle motors employed in peripheral information devices in which the improvement comprises a step of lubricating said bearings with a grease composition containing:

a carbonate compound of the following general formula (i) serving as a base oil

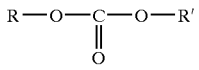

(i)

wherein R and R' may be the same or different and independently represent a branched alkyl group having from 13 to 15 carbon atoms;

a lithium soap serving as a thickener; and at least one organomolybdenum compound selected from the group consisting of a molybdenum dithiophosphate of the general formula (ii)

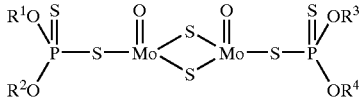

(ii)

wherein $R^1$, $R^2$, $R^3$ and $R^4$ independently represent an alkyl group having from 1 to 24 carbon atoms or an aryl group having from 6 to 30 carbon atoms, and a molybdenum dithiocarbamate of the general formula (iii)

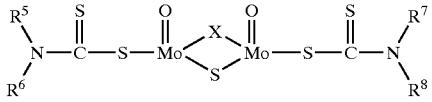

(iii)

wherein $R^5$, $R^6$, $R^7$ and $R^8$ independently represent an alkyl group having from 1 to 24 carbon atoms, and X represents O or S.

9. The grease composition of claim 1, wherein the base oil consists essentially of the carbonate compound of general formula (i).

10. The grease composition of claim 3, wherein the base oil consists essentially of the carbonate compound of general formula (i).

11. The grease composition of claim 7, wherein the base oil consists essentially of the carbonate compound of general formula (i).

12. The method of claim 8, wherein the base oil consists essentially of the carbonate compound of general formula (i).

13. The grease composition of claim 1, consisting essentially of the carbonate compound, lithium soap and at least one organomolybdenum compound.

14. The grease composition of claim 7, consisting essentially of the carbonate compound, lithium soap and at least one organomolybdenum compound.

15. The method of claim 8, wherein the grease composition consists essentially of the carbonate compound, lithium soap and at least one organomolybdenum compound.

16. The grease composition of claim 1, consisting of the carbonate compound, lithium soap and at least one organomolybdenum compound.

17. The grease composition of claim 7, consisting of the carbonate compound, lithium soap and at least one organomolybdenum compound.

18. The method of claim 8, wherein the grease composition consists of the carbonate compound, lithium soap and at least one organomolybdenum compound.

* * * * *